United States Patent [19]

Watkins et al.

[11] Patent Number: 5,044,777

[45] Date of Patent: Sep. 3, 1991

[54] FLAT-FACED PACKAGE FOR IMPROVING THE MICROWAVE POPPING OF CORN

[75] Inventors: Jeffrey T. Watkins, Bloomington; Lawrence C. Brandberg, Edina, both of Minn.

[73] Assignee: Golden Valley Microwave Foods Inc., Edina, Minn.

[21] Appl. No.: 604,759

[22] Filed: Oct. 26, 1990

[51] Int. Cl.[5] ..... B65D 81/34

[52] U.S. Cl. ..... 383/100; 383/98; 219/10.55 E

[58] Field of Search ..... 383/98, 100, 120; 426/107, 109, 113, 114; 219/10.55 E

[56] References Cited

U.S. PATENT DOCUMENTS

| | | | |
|---|---|---|---|
| 2,041,227 | 5/1936 | Chalmers | 229/87 |
| 2,149,872 | 3/1939 | Schmidt | 229/58 |
| 3,027,261 | 3/1962 | Samara | 99/171 |
| 3,052,554 | 9/1962 | Colman | 99/171 |
| 3,286,832 | 11/1966 | Pilger | 206/56 |
| 3,293,048 | 12/1966 | Kitterman | 99/171 |
| 3,637,132 | 1/1972 | Gray | 229/53 |
| 3,851,574 | 12/1974 | Katz | 426/107 |
| 3,873,735 | 3/1975 | Chalin et al. | 426/87 |
| 3,970,241 | 7/1976 | Hanson | 229/58 |
| 4,038,425 | 7/1977 | Brandberg et al. | 426/107 |
| 4,219,573 | 8/1980 | Borek | 426/107 |
| 4,450,180 | 5/1984 | Watkins | 426/107 |
| 4,553,010 | 11/1985 | Bohrer et al. | 219/10.55 E |
| 4,571,337 | 2/1986 | Cage et al. | 383/100 |
| 4,691,374 | 9/1987 | Watkins et al. | 383/104 |
| 4,735,513 | 4/1988 | Watkins et al. | 383/116 |
| 4,851,246 | 7/1989 | Maxwell et al. | 219/10.55 E |
| 4,864,090 | 9/1989 | Maxwell et al. | 426/107 |
| 4,878,765 | 11/1989 | Watkins et al. | 383/116 |
| 4,892,744 | 1/1990 | Ylvisaker | 383/120 |
| 4,904,488 | 2/1990 | LaBaw et al. | 426/107 |
| 4,982,064 | 1/1991 | Hartman et al. | 426/107 |

FOREIGN PATENT DOCUMENTS 81544 12/1956 Denmark .

*Primary Examiner*—Gary E. Elkins

*Attorney, Agent, or Firm*—James V. Harmon

[57] ABSTRACT

A package is described comprising a bag with a pair of face D joined by longitudinally extending centrally projecting gussets. The bottom of the bag has a strong permanent seal and the top has a rupturable seal formed from thermoplastic adhesive that allows the top to open during popping to form a vent. The bottom seal includes adhesive seals that extend diagonally from the center of the bag obliquely toward the side edges and is pinched shut to provide a fin seal across the entire lower end of the bag. The top seal has diagonal adhesive seals on each side which are constructed and arranged to provide free-standing, outwardly projecting triangular corner flaps with sealed edges on each side. Their diagonal edges intersect at two spaced apart points near the center of the bag. The points at the intersecting ends of the four flaps define the steam vent area for the bag. The diagonal seals at the top and bottom ends intersect the bag face containing the susceptor at four points A–D to define a rectangular area that remains relatively flat while the corn is popped in the microwave oven.

When the bag is in a flat condition, the gussets extend toward one another, almost to the center of the bag. The centermost folds of the gussets are therefore close enough together to the divide the bag into two parallel chambers: a lower chamber between the lower panel of the bag and the gussets, and an upper chamber between the gussets and the upper panel of the bag. The upper chamber is held shut with tack seals while the lower chamber is opened to receive the popcorn and shortening when the package is filled.

5 Claims, 3 Drawing Sheets

FLAT-FACED PACKAGE FOR IMPROVING THE MICROWAVE POPPING OF CORN

FIELD OF THE INVENTION

The present invention relates to food packages and more particularly to flexible packages suited for popping popcorn in a microwave oven.

BACKGROUND OF THE INVENTION

Various kinds of square cut or square end gusseted bags have been previously proposed for popping corn in a microwave oven. U.S. Pat. No. 4,691,374 describes a cooking bag in which diagonal gusset seals are shown at the bottom of the bag (FIGS. 1, 3 and 4). Although very good, the bag does have certain shortcomings. It will be noticed that the bag in FIG. 9 has a generally oval shape resembling an inflated football. In the work leading to the present invention, we have now discovered that the tendency of the bag to form an oval or football shape during popping in the oven has a bearing on the effectiveness of the susceptor (microwave interactive sheet material) provided in one face of the bag for absorbing microwave energy and transferring the energy in the form of heat to pop the corn. It was also discovered that where the lower panel of the bag begins to bend upwardly at each end the bag tended to scorch, primarily because the food was not in contact with the susceptor at that point.

In view of these shortcomings, it is an important objective of the invention to find a way to improve the shape of the package as it expands during popping of corn in a microwave oven to allow the susceptor provided in one face panel of the bag to operate more effectively. It is another object to find a way of changing the shape of the bag so that the susceptor can be made larger in size without causing excessive scorching, charring or burning. Another object is to find a way during expansion of the bag in a microwave oven to maintain one face, particularly the lower face of the bag, in a flat condition so that it conforms better to the floor of the microwave oven. Another object is to increase the area of the lower face panel. A more general object is to find a way of controlling the shape of a microwave corn popping bag to improve the performance of the bag as measured by the volume of popped corn, the expansion density of the popped corn, the number of unpopped kernels, steam venting reliability and bag scorching.

These and other more detailed and specific objects of the present invention will be apparent in view of the following description setting forth by way of example but a few of the various forms of the invention that will be apparent to those skilled in the art once the principles described herein are understood.

SUMMARY OF THE INVENTION

A package is described comprising a bag with a pair of face panels joined by longitudinally extending centrally projecting gussets. The bottom of the bag has a strong permanent seal and the top has a rupturable seal formed from thermoplastic adhesive that allows the top to open during popping to form a vent. The bottom seal includes adhesive seals that extend diagonally from the center of the bag obliquely toward the side edges and is pinched shut to provide a fin seal across the entire lower end of the bag. The top seal has diagonal adhesive seals on each side which are constructed and arranged to provide free-standing, outwardly projecting triangular corner flaps with sealed edges of the top seal on each side. Their diagonal edges intersect at two spaced apart points near the center of the bag. The points at the intersecting ends of the four flaps define the steam vent area for the bag. The diagonal seals at the top and bottom ends intersect the bag face containing the susceptor at four points A–D to define a rectangular area that remains relatively flat while the corn is popped in the microwave oven.

When the bag is in a flat condition, the gussets extend toward one another, almost to the center of the bag. The centermost folds of the gussets are therefore close enough together to divide the bag into two parallel chambers: a lower chamber between the lower panel of the bag and the gussets, and an upper chamber between the gussets and the upper panel of the bag. The upper chamber is held shut with tack seals while the lower chamber is opened to receive the popcorn and shortening when the package is filled.

The invention will now be described by way of example with reference to the following figures.

THE FIGURES

DESCRIPTION OF THE PREFERRED EMBODIMENTS

Figure 1:
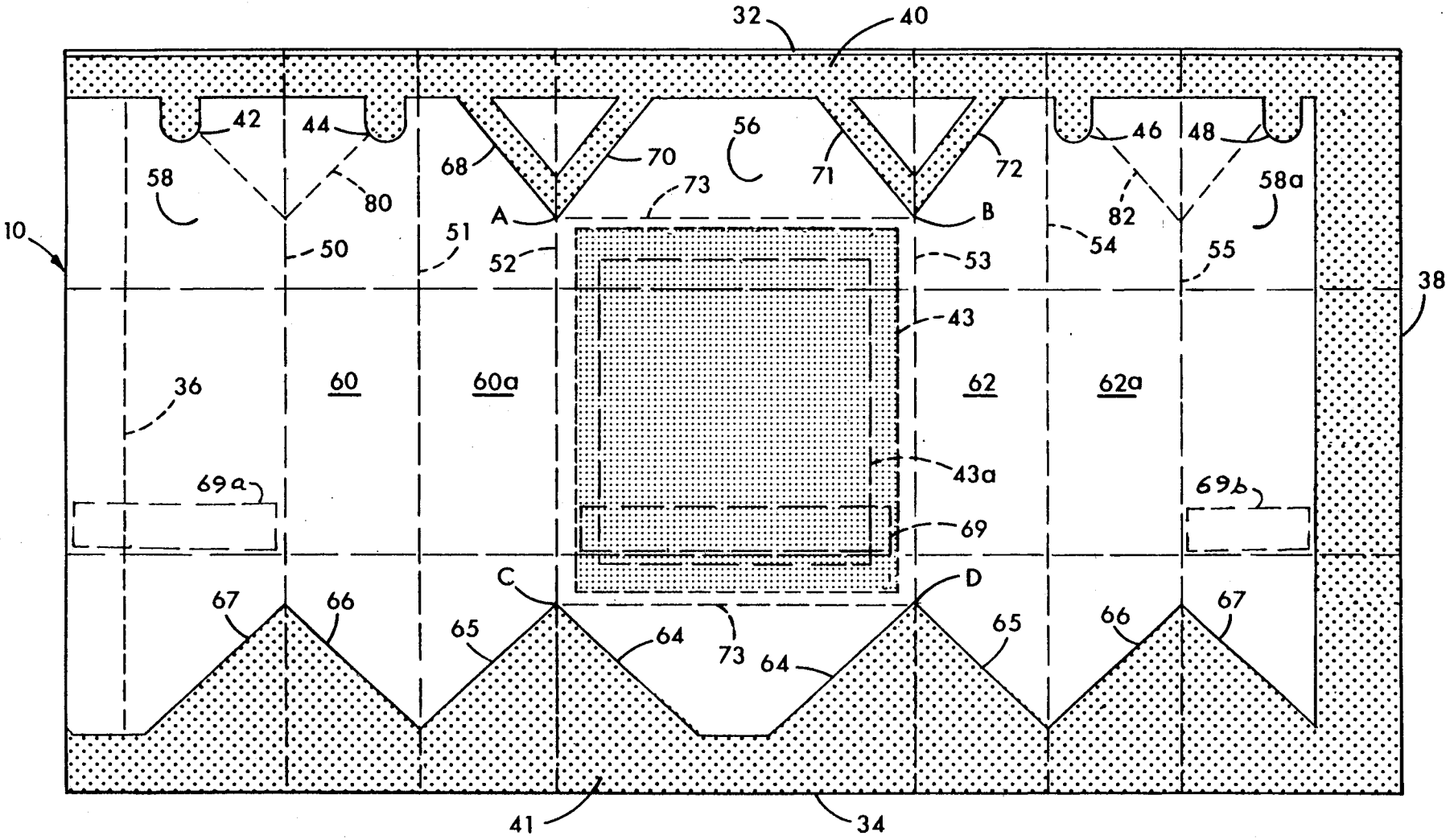
FIG. 1 is a plan view of the inside surface of a blank sheet of paper from which the package is formed, showing a preferred adhesive pattern and susceptor.

Refer now to FIG. 1 which illustrates the inside of a flexible sheet 10 from which a bag 22 is composed to provide a package. It can be seen that the sheet 10 is generally rectangular in shape and includes parallel top and bottom edges 32 and 34, respectively, with parallel side edges 36 and 38 running at right angles thereto. The edge 32 forms the top of the bag while edge 34 forms the bottom of the bag. The side edges 36 and 38 are bonded in overlapping relationship as will be described below to form a longitudinally extending lap seal.

On the inside surface of the sheet 10 are a pair of top and bottom thermoplastic adhesive sealing bands 40 and 41, respectively, which can be applied using any suitable adhesive applying equipment. The adhesive bands 40 and 41, while they can be formed from any suitable commercially available adhesive, are preferably formed from a heat sensitive thermoplastic adhesive such as polyvinyl acetate or polyvinyl acetate copolymer adhesive at a coating weight of 5-7 lb/ream. One suitable adhesive is a thermosetting polyvinyl acetate emulsion adhesive which can be obtained, for example, from Franklin International, Inc., Columbus, Ohio, under the trade name Duracet 12. Other adhesvies such as dextrine or starch base adhesive can be used if desired. Thermoplastic heat sealing adhesives are preferred when the bags are formed on high-speed automatic tubing and filling equipment in which case seals are produced by holding the adhesive bands 40 and 41 together under heat and pressure.

The bands 40 and 41 can be of various widths but a fairly wide band, for example a band about ⅞" wide, is preferred so that there is adequate room for "float," i.e., the variations in the position of the sheet 10 with respect to the heated sealing jaws used for forming the seals.

The longitudinal seal 28 is formed by providing vertically disposed adhesive bands along the longitudinal edges 36 and 38 and on opposite surfaces of the blank sheet 10. The adhesive bands on edges 36 and 38 are also preferably formed from thermoplastic adhesive but a quick-setting dextrine adhesive or a resin type adhesive can be used if desired. The bands along edges 36 and 38 contact one another when the bag 22 is formed with an overlap at lap seal 28. Consequently, a strong bond is formed between the two face-to-face adhesive layers. Similarly, in the case of the end seals formed by adhesive bands 40 and 41, an adhesive band is always in contact with a part of the adhesive band on an opposing surface so that one layer of adhesive is sealed to another in face-to-face relationship. In this way, a secure bond is formed which is stronger than one produced with a single layer of adhesive bonded to plain paper.

The sheet 10 is preferably formed from two plies, e.g. an inner bleached greaseproof kraft paper of 25 lb/ream laminated to an outer plain bleached kraft sheet of 30 lb/ream by means of a suitable adhesive with a microwave susceptor 43, e.g. a metallized plastic film, sandwiched between the two kraft plies as described in U.S. Pat. Nos. 4,735,513, 4,878,675 or a coating as described in Ser. No. 456,159, now U.S. Pat. No. 4,970,358. When the susceptor 43 is a coated film, a preferred adhesive to be used between the susceptor and the inner greaseproof kraft layer is polyvinyl acetate resin-based emulsion adhesive such as Elektromek vinylacetate copolymer adhesive supplied by the Elektromek Company, Carlstadt, New Jersey. The Duracet 12 adhesive can be used elsewhere between the inner and outer paper sheets, both adhesives at a coating weight of 4-6 lb/ream. For a comparison, the smaller susceptor that was formerly used is shown at 43*a*. The susceptor 43 can be made in some cases as much as 25 percent larger than formerly used.

Figure 4:
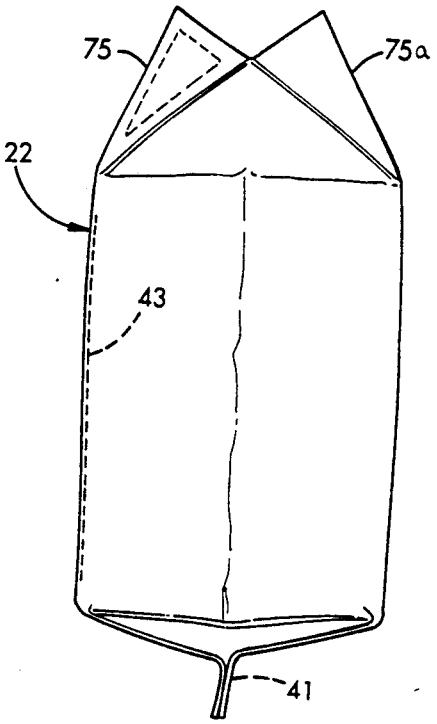
FIG. 4 is a side view of the package after the popcorn has been popped in a microwave oven.
Figure 5:
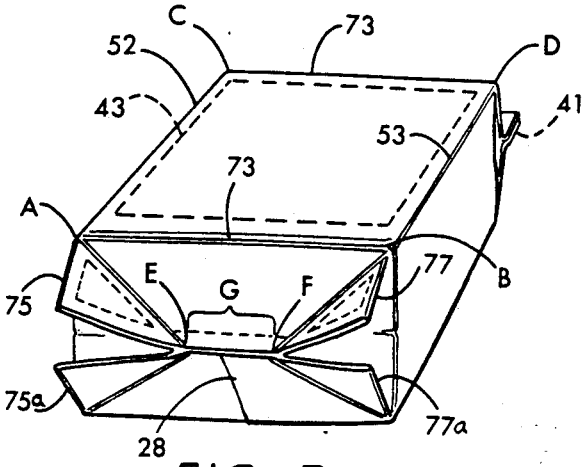
FIG. 5 is a perspective top end view of the package just after popping, with the package inverted with the lower face uppermost so that the susceptor can be seen.
Figure 6:
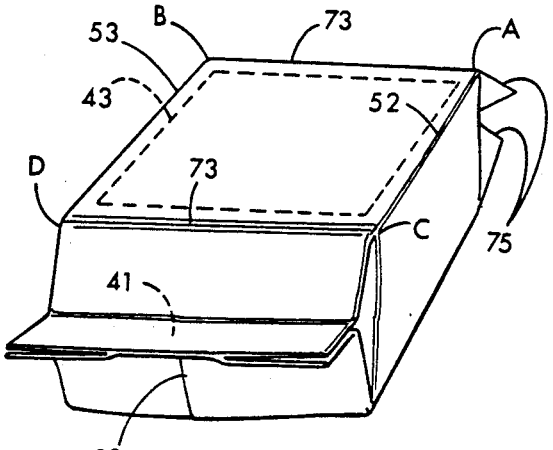
FIG. 6 is a perspective bottom end view of the package as it appears just after popping, but the package is inverted to show the lower face so that the susceptor can be seen.

The sheet 10 is folded to form bag 22 during manufacture along six lines designed 50-55. The lines 50-55 do not indicate creases but only where folds will be formed when the bag 22 is completely assembled. Precreasing is not necessary for most applications. Between fold lines 52 and 53 is a lower panel 56. The upper face panel at the right of the bag (FIG. 4) is formed by panel portions 58, 58*a* on opposite sides of fold lines 50 and 55, respectively. Between the upper face panel 58, 58*a* and the lower face panel 58 are gusset panels, the ones on the left in FIG. 1 being designated 60, 60*a*, while the ones on the right are designated 62 and 62*a*. The gusset panels are connected by the gusset folds 51 and 54, respectively.

At the bottom of the bag 22 are provided diagonal seals similar to those in U.S. Pat. No. 4,691,374 which correspond in position to diagonal edges of adhesive patches 64-67. The diagonal seal edges comprise seals between the gusset and each face panel comprising a pair of diagonal seal edges on the left and right side of the bag where diagonal patch 66 is sealed to patch 67 and diagonal patch 65 is sealed to patch 64. All of the diagonal seal edges are inclined upwardly and outwardly away from the center of the bag and serve to bond each gusset panel to a portion of an adjacent face panel (upper or lower) in contact therewith. It should be clear that although adhesive bands have been shown on both the gussets and the adjacent face panels, it would be acceptable to use a band on only one of them although a somewhat less secure bond would be formed.

Figure 7:
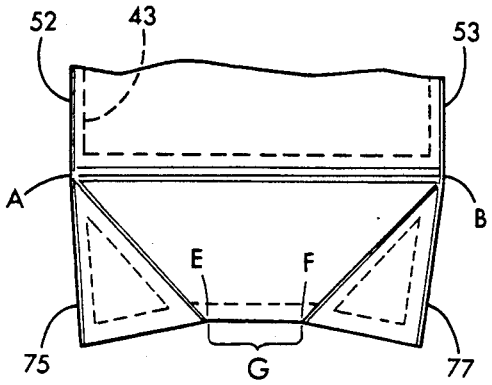
FIG. 7 is a plan view of the top end of the package of FIG. 5 on a slightly larger scale.
Figure 8:
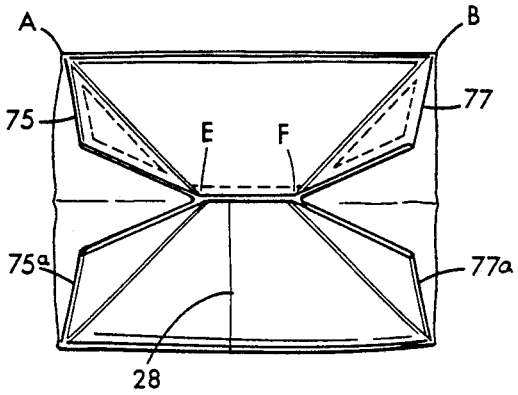
FIG. 8 is an end elevational view of the top end of the package as seen in FIG. 7 prior to the venting of steam from package.
Figure 9:
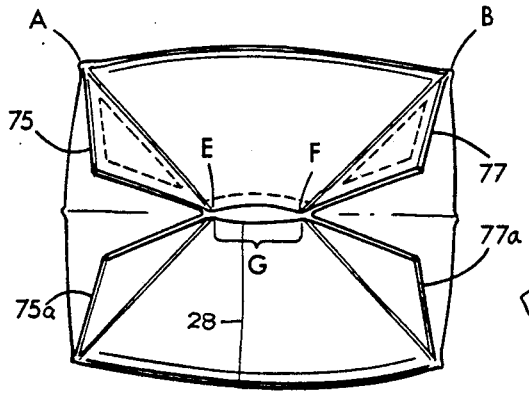
FIG. 9 is a view similar to FIG. 8 during the venting of steam.

At the top of the bag are provided a second set of seals having diagonal edges which comprise a first set of mating seals 68, 70 and a second set of mating seals 71, 72. Both sets are adapted to seal the gusset panels 60*a*, 62 to the lower face panel 56. It will be seen that the seals 68-72 are positioned so that the diagonal edges are inclined along lines that extend upwardly and centrally proceeding toward the top edge 32 of the bag. The diagonal adhesive seals on each side of the bag top with adhesive strip 40 are constructed and arranged as shown to form four free-standing, outwardly projecting triangular flaps or pleats 75, 75*a*, 77, 77*a* with diagonal sealed edges on each side of the bag which intersect at two spaced apart points E and F near the center of the bag at the top end 32. The space between the points E, F at the intersection of the triangular flaps 75, 77 defines a steam vent area G which is shown closed in FIGS. 7 and 8 and shown open as it appears when steam is being vented in FIG. 9 during the last stages of popping.

It was discovered that, upon heating the bag in a microwave oven until the corn pops, the apex of the sealed areas 68, 70 at A and those of diagonal seals 71-72 at B, cooperate with the apex of the points of the adhesive patches 64, 65 at C and D so that the four points of intersection A, B, C and D determine a rectangular lower panel area 73 containing the susceptor 43. The intersection between the glued ends and lower panel area determined by four points A, B, C and D causes the lower panel area 73 to remain relatively flat and to conform well to the oven floor during popping.

Extending downwardly from the adhesive band 40 toward the bottom of the bag are two mating adhesive patches 42, 44 at the left which are sealed to one another and two mating patches 46, 48 at the right which also seal together. The patches 42, 44, 46, 48 serve as tack seals for sealing together an upper bag chamber 55 as will be described more fully below.

Figure 2:
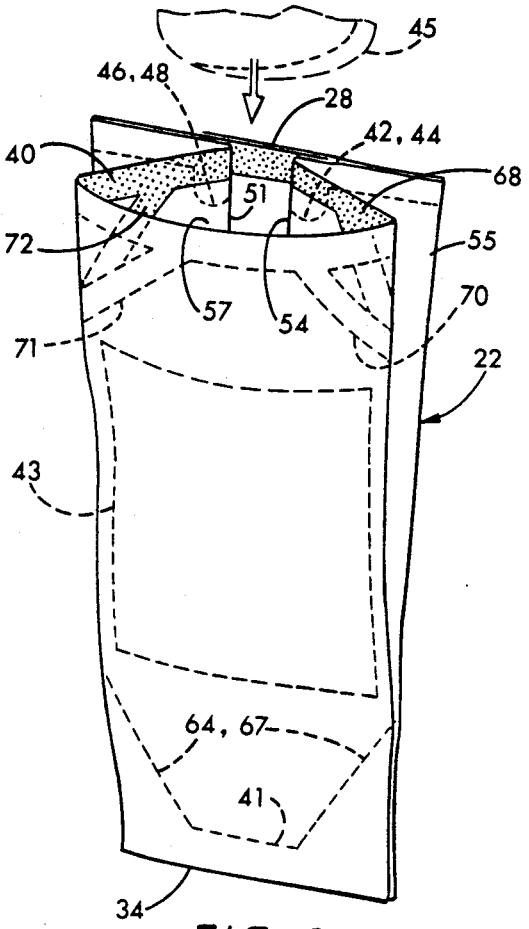
FIG. 2 is a perspective view of the package during filling just before a food product is introduced.
Figure 3:
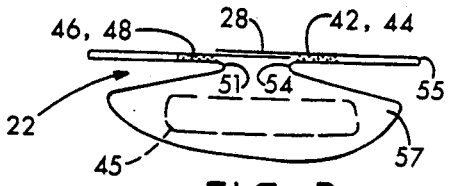
FIG. 3 is a top view of FIG. 2.

The gusset folds 51 and 54 divide the bag into two compartments: a collapsed compartment 55 and an expanded compartment 57. The tack seals 42, 44, 46, 48 as shown in FIGS. 2 and 3 are formed prior to filling the bag with popcorn 45. The tack seals 42, 44, 46 and 48 hold the compartment 55 securely in its collapsed condition so that the compartment 57 can be fully expanded to receive a charge of popcorn and shortening 45. This greatly assists in efficient filling of the bag. In fact, in a typical plant run, the tack seals reduced the wastage of popcorn spilled on the floor by about 60 to 100 pounds of popcorn per filling machine per day.

The bag described in U.S. Pat. No. 4,691,374 and all of the other microwave popcorn bags currently being marketed tend to form an oval or football shape when inflated. By contrast, the present invention, owing to the cooperation of the diagonal seals at the bottom and the provision of the free-standing outwardly projecting triangular flaps 75, 77 which converge at two spaced apart points E and F, forms a large lower panel 73 that stays flat to support the susceptor 43 as the package expands during microwave heating. This gives the package a rectangular or box-shaped configuration which substantially improves the popping performance as measured by the volume of popped corn, expansion density of the popped corn, the number of unpopped kernels remaining, package venting and bag scorching. The box shape also tends to be more consistent in shape and popping characteristics and is less affected by variables such as the rate of expansion, paper moisture, corn moisture, etc. Additionally, the susceptor 43 can safely be made larger than the susceptor 43*a* that was formely used (FIG. 1).

If desired, adhesive patches 80, 82 having diagonal edges can be employed between the gussets and the upper panel 58, 58*a* of the bag in alignment with the diagonal seals 68–72.

Three horizontally disposed patches of product-locating adhesive 69, 69*a* and 69*b* (FIG. 1) are provided to keep the food product 45 from falling all the way to the bottom 34 of the bag 22 in a manner similar to that described in U.S. Pat. No. 4,691,374.

It was discovered that the improved rectangular or box-like shape of the package that has been achieved enhances the popping of the corn and overall performance. The angle of intersection of the diagonal seals affects the final bag geometry and can be optimized for different conditions. Good results have been achieved with an angle of about 42°–55° to the longitudinal axis of the bag for the lower and upper diagonal seals.

The term "diagonal seal" means a seal that has a diagonal edge relative to the longitudinal axis of the bag. The triangular areas within the seals 68–72 can be entirely covered with adhesive if desired. Moreover, adhesive can cover the entire surface of the paper if desired. Heated jaws can be used to seal the ends of the bag. In this case, the shape of the sealing jaws alone can be used to determine where the seals are located. Thus, the heat seal can be determined by the pattern of the heal seal adhesive or, if desired, by the pattern of the jaws. The amount of heat seal adhesive used and the inherent strength of the adhesive can be used to control the quality of the adhesive joints. After the bag is formed and tack seals are produced, the popcorn and shortening 45 are introduced into chamber 57 as shown in FIGS. 2 and 3. The top seal is then formed with appropriately shaped heat sealing jaws.

Figure 10:
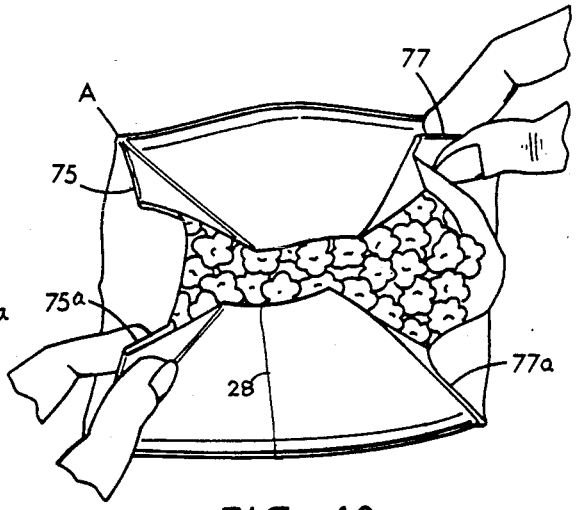
FIG. 10 is a view similar to FIG. 9 as the package appears as it is being opened.

After popping, the popcorn is removed from the bag by manually opening the top as shown in FIG. 10. The start of an opening at the top is produced through the vent G by internal steam pressure. As this occurs, the seal 40 at the top of the bag peels open when the internal pressure becomes sufficiently high. By having the top seal 40 of the bag weaker than the bottom seal 42, the bag 22 will always pop open at the top and is thus self-venting. Moreover, it will always open at the same spot G between the intersections of diagonal seals at E and F.

Many variations of the present invention within the scope of the appended claims will be apparent to those skilled in the art once the principles described herein are understood.

What is claimed is:

1. A bag for popping popcorn in a microwave oven comprising, a pair of upper and lower rectangular face panels having parallel top and bottom edges defining the top and bottom of the bag and each face panel having parallel side edges at right angles thereto, left and right longitudinally extending centrally projecting gusset folds extending between the upper and lower panels of the bag, the gussets separating the bag into a pair of communicating chambers, seals having diagonal edges at both the top and bottom of the bag between the gussets and at least the lower face panel, the diagonal seals having edges extending diagonally from the side edge of the lower face panel proceeding centrally and toward the adjacent end of the bag, the bottom end of the bag being pinched shut transversely all the way across to provide a permanent fin seal at the bottom end of the bag, the diagonal seals at the top of the bag between the gusset folds and the lower face of the bag being constructed and arranged to provide free-standing outwardly projecting triangular flaps with diagonally extending sealed edges that terminate near the center of the bag at two spaced apart points, the space between said two points at the ends of the flaps defining a steam vent area of the bag that opens under the influence of internal pressure during cooking, the outer ends of the diagonal seals intersecting the lower face panel at four points A, B, C and D such that the triangular flaps define the top edge of a rectangular lower face area determined by points A, B, C, D containing a microwave interactive susceptor that remains relatively flat during popping of the popcorn in a microwave oven to provide a relatively large and flat supporting panel to enhance popping of the corn.

2. The package of claim 1 wherein the diagonal seals have an angle between about 42°–55° relative to the longitudinal axis of the package.

3. The package of claim 1 wherein tack seal means is provided for sealing a compartment of the bag in a closed condition while a second compartment of the bag is open for the insertion of popcorn.

4. The package of claim 3 wherein the tack seal means comprises patches of adhesive between the gussets and the upper face panel of the bag adjacent to one end for sealing the gussets to the upper face panel while the popcorn is inserted into the bag.

5. The package of claim 1 wherein diagonal seals are provided between the gussets and the upper and lower face panels of the bag at both the top and bottom ends thereof.

* * * * *